US005740958A

United States Patent [19]

Cai

[11] Patent Number: 5,740,958

[45] Date of Patent: Apr. 21, 1998

[54] BEVERAGE CARTON

[75] Inventor: Liming Cai, West Chester, Pa.

[73] Assignee: Dopaco, Inc., Exton, Pa.

[21] Appl. No.: 808,038

[22] Filed: Mar. 4, 1997

[51] Int. Cl.[6] ..... B65D 5/10; B65D 5/42

[52] U.S. Cl. ..... 229/103.1; 229/155

[58] Field of Search ..... 229/103.1, 103.2, 229/103.3, 155; 206/427

[56] References Cited

U.S. PATENT DOCUMENTS

| | | | |
|---|---|---|---|
| D. 358,092 | 5/1995 | Cai . | |
| 2,060,240 | 11/1936 | Pergande | 229/155 |
| 2,898,028 | 8/1959 | Coe | 229/155 |
| 3,186,545 | 6/1965 | Conrades | 229/103.2 |
| 3,261,537 | 7/1966 | Kistner | 229/103.2 |
| 3,758,019 | 9/1973 | Struble | 229/103.3 |
| 4,036,392 | 7/1977 | Martin | 229/103.1 |
| 4,049,189 | 9/1977 | Wood | 206/427 |
| 4,773,540 | 9/1988 | Schuster | 206/427 |
| 5,358,175 | 10/1994 | Cai . | |

FOREIGN PATENT DOCUMENTS

| | | | |
|---|---|---|---|
| 1110600 | 2/1956 | France | 229/155 |
| 1355681 | 2/1964 | France | 229/155 |

*Primary Examiner*—Gary E. Elkins

*Attorney, Agent, or Firm*—Dennison, Meserole, Pollack & Scheiner

[57] ABSTRACT

A carton with a closure assembly including opposed inner flaps, one with a straw receiving aperture defined therethrough, and outer locking flaps, one with a folding edge flange thereon having inner and outer tongues selectively engagable within a flap-defined keeper opening having locking edges beneath which the tongues engage.

4 Claims, 2 Drawing Sheets

BEVERAGE CARTON

BACKGROUND OF THE INVENTION

The invention broadly relates to cartons folded from unitary blanks of paperboard, and is particularly concerned with take-out beverage containers of the type used by fast food establishments.

Such containers, to be practical, must be capable of being easily yet effectively closed. As will be appreciated, the efficiency with which such cartons can be filled, closed and handed to the customer is significant in maintaining the required "fast" service.

SUMMARY OF THE INVENTION

The lidded beverage carton of the invention, selectively closed by inner-support flaps and outer locking flaps, utilizes a unique lock assembly which can be engaged both expeditiously and without difficulty. In order to enhance the practicability of the lock assembly, provision is made for two degrees of engagement, the lock assembly providing a secure closure in either case.

The lock assembly, while providing for a secure closing of the carton, is readily disengaged should one wish to pour or drink the contents from the receptacle. Should one wish to drink the contents using a straw, a self-closing aperture is provided through one of the underlying support flaps with the aperture being so positioned as to be readily accessible after a locking of the overlying locking flaps. Prior to the introduction of a drinking straw, the aperture remains closed to minimize leakage.

Structurally, the lock assembly, integrally defined from the two locking flaps, includes an elongate opening or keeper in one flap having opposed parallel locking edges. The second locking flap includes an integral flange defined transversely across the free edge portion thereof and foldable relative to the flap. The flange includes a first tongue centered along the fold line and defined from the corresponding locking flap inward of the flange, and a second outer tongue centered along the outer edge of the flange. These tongues are selectively or jointly engaged under one or both of the locking edges of the keeper, thus achieving the desired positive engagement of the lock assembly.

Addition objects and features of the invention will become apparent from the more detailed description following hereinafter.

DESCRIPTION OF THE PREFERRED EMBODIMENTS

Figure 1:
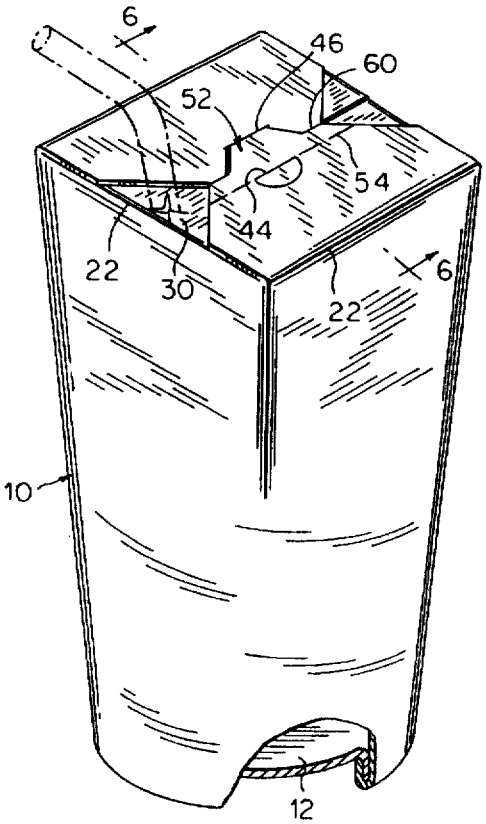
FIG. 1 is a top perspective view of the beverage carton of the invention with the lid flaps closed and locked.
Figure 2:
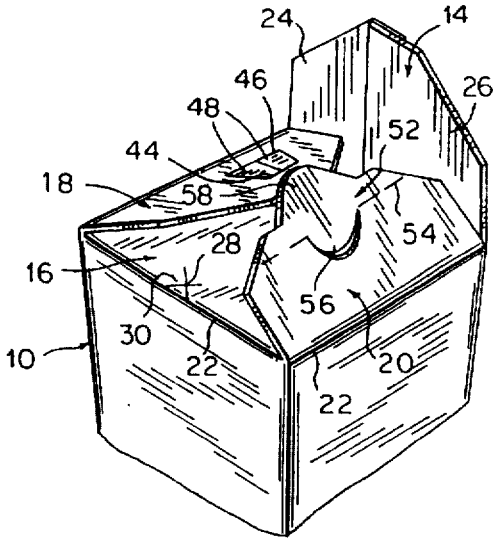
FIG. 2 is a perspective view of the upper portion of the carton with the lid flaps partially folded.

Referring now more specifically to the drawings, the beverage carton of the invention has a vertically elongate hollow body 10 with the upper portion thereof, at the upwardly opening mouth, being of a rectangular, preferably square, cross section. The body 10 of the carton, which may be rectangular or cylindrical in cross section below the rectangular upper portion thereof, mounts a bottom panel 12 to define an upwardly opening receptacle.

The upwardly opening mouth of the body 10 is formed by the peripheral upper edge of the body and is selectively closed by a pair of opposed inner support flaps 14 and 16 and opposed outer locking flaps 18 and 20. The flaps, in each instance, are co-extensive with the corresponding substantially linear edge portions of the mouth defined by the rectangular cross section of the upper portion of the body 10 with each flap being integral with the corresponding side upper edge, along fold lines 22 defining the upper edge portions for a selected folded closing of the flaps.

Figure 7:
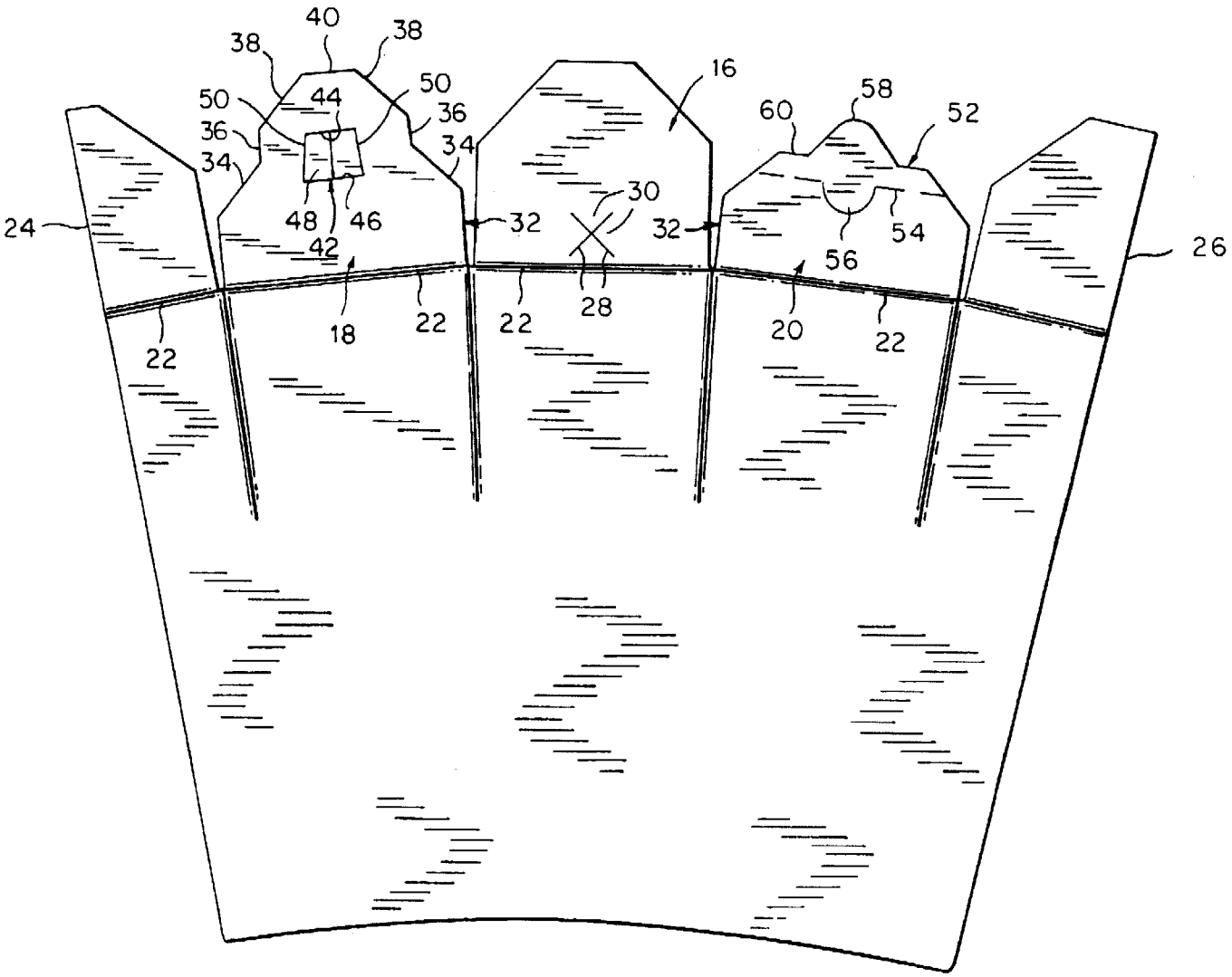
FIG. 7 is a plan view of the blank from which the carton is folded.

Noting the blank of FIG. 7, it will be seen that the body and flaps are formed from a unitary blank of appropriate foldable material such as coated paperboard and the like. The the like. The flaps 14–20, which define the closure for the carton 10 are integral with the upper edge of the body portion along the linear fold lines 22. The inner support flap 16, which is a unitary panel, is centrally located with the upper locking flaps 18 and 20 positioned to the opposite sides thereof. The second inner support flap 14 is defined by a pair of overlapping panels 24 and 26 immediately outward of the locking flaps 18 and 20 respectively. Upon a folding of the blank into the carton, the panel 26 slightly overlaps the panel 24 and is adhesively bonded thereto, forming the support flap 14 which, in configuration, duplicates the support flap 16.

The inner flaps 14 and 16 include tapered truncated outer end portions which freely overlap each other upon a closure of these flaps 14 and 16 over the open mouth of the carton body 10. The inner support flap 16, centrally thereof and adjacent the corresponding fold line 22, includes a pair of slits 28 at right angles to and crossing each other to define four flexible triangular tabs 30 meeting at a common center. The resilient flexibility of the tabs 30 is derived from the inherent nature of the paperboard material, and allows for the insertion of a drinking straw through the opening defined as the straw is inserted. The tabs provide a positive frictional grip on an inserted straw for both a retention of the straw and a partial sealing of the opening defined by the insertion of the straw. The crossed slits 28, and the tabs 30 formed thereby, remain exposed in the completely closed carton due to the specific location thereof in the base or inner portion of the flap 16 adjacent the corresponding fold line 22 and in light of the specific configurations of the locking flaps 18 and 20.

The locking flap 18 has opposed side edges 32 which extend outward from the corresponding fold line 22 substantially parallel or at a slight outward convergence to each other. At a point outwardly spaced from the fold line 22, the side edges, as indicated at 34, converge more sharply inward and terminate in parallel outwardly directed relatively short lengths 36 which in turn terminate in converging edge lengths 38 defining a truncated triangular outer flap portion. So configured, the positioning flap 18 progressively narrows from the fold line 22 to the outer edge 40 thereof.

The locking flap 18 is to be folded to its closed position prior to the folding of the locking flap 20 thereover. In order to engage the locking flaps to each other, a lock assembly is provided which includes a keeper or keeper opening 42 through the flap 18 on a center line extending from the fold line 22 to the outer edge 40, and at a position approximately aligned with the juncture between the lengths 34 and 36 on each side wall 32. The keeper 42 is of a slightly truncated configuration with first and second parallel edges 44 and 46, the edge 44 being closer to the outer edge 40 of the flap 18 and slightly shorter than the edge 46. The actual opening of the keeper 42 is formed by two leaves 48 which extend inwardly from fold lines 50 defining the opposed side edges of the keeper 42. The leaves 48 meet centrally and tend to close the keeper opening until such time as the lock assembly is engaged.

The lock assembly is completed by a flange 52 transversely across the slightly tapered outer end portion of the locking flap 20 and defined by fold line 54. The fold line 54 is interrupted along a central portion thereof and a first inner tongue 56, of generally semi-circular configuration, is defined and cut from the flap 20 inward of the fold line 54 and forms an integral co-planar continuation of the flange 52 whereby, upon a folding of the flange 52 about the fold line 54, the tongue 56 will remain in the plane of the flange 52 and move out of the plane of the flap 20 inward thereof. A second, slightly larger tongue 58 is integral and co-planar with the flange 52 and projects outwardly from the outer edge 60 of the flange centrally thereof.

Figure 3:
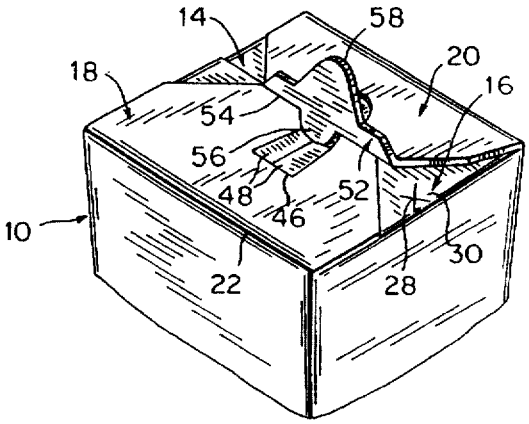
FIG. 3 is a perspective view of the upper portion of the carton with the inner locking tongue aligned for engagement with the keeper.
Figure 4:
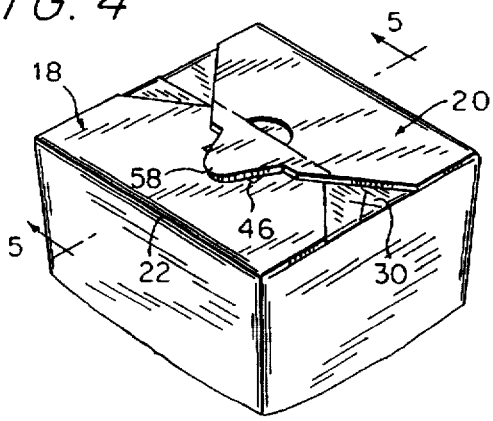
FIG. 4 is a view similar to FIG. 3 with the inner locking tongue engaged.
Figure 5:
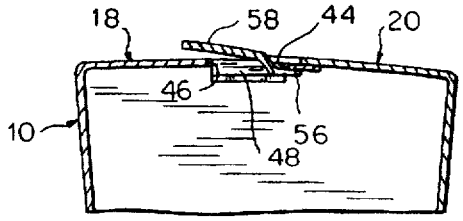
FIG. 5 is a cross-sectional detail taken substantially on a plane passing along line 5—5 in FIG. 4.

In closing the carton 10, the inner support flaps 14 and 16 are closed, one over the other. The lower locking flap 18, with the keeper 42 defined therein, is then folded over the inner flaps, and the upper locking flap 20 is folded over locking flap 18. As the flap 20 is closed over the flap 18, the flange 52 is folded outward about the fold line 54, as suggested in FIG. 3. Thus, the inner tongue 56 depends below the flap 20 and aligns with the keeper 42 immediately inward of the locking edge 44. Upon a further closing movement of the flap 20, the tongue 56 pushes through the keeper leaves 48 and, as it passes into the keeper, the flange 52 is pivoted back toward its original position to lockingly engage the tongue 56 below the flap 18 inward thereof or toward the flap fold line 22. The engagement of and the fully engaged tongue 56 will be best appreciated from FIGS. 3, 4 and 5. As will be appreciated, the flange fold line 54, as well as the tongue 56, are so oriented as to allow for substantial alignment of the fold line 54 over the inner locking edge 46 and full seating of the tongue 56 below the keeper after engagement through the keeper. The inherent flexibility and resiliency of the paperboard of the carton, while allowing for a flexing of the keeper leaves 48 to engage the tongue 56, encourages a return of these leaves 48 to their original position after insertion of the tongue, thereby tending to effect a positive retention of the engaged tongue 56 against accidental dislocation. In the same manner, the flange 52 will tend to return to its original unfolded position to likewise secure the lock assembly. The exposed outer tongue 58 provides a convenient means for grasping the flange and disengaging the lock assembly for an opening of the carton.

Figure 6:
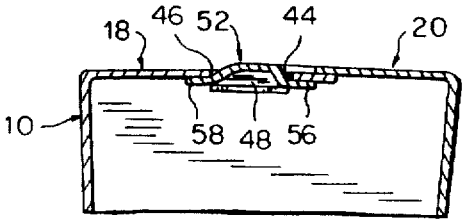
FIG. 6 is a cross-sectional detail taken substantially on a plane passing along 6—6 in FIG. 1 and illustrating the lock assembly with both the inner tongue and the outer tongue engaged.

With reference to FIGS. 1 and 6, in those cases wherein an even more secure lock is desired, as for example when the filled carton is to be stored for a period of time, the outer tongue 58, by a downward pressure thereon or adjacent thereto, can be snap-engaged beneath the keeper edge 46, thereby effecting a positive engagement of both longitudinal edge portions of the flange 52. It will be appreciated that the width of the flange 52 between the outer edge 60 and the fold line 54 is such as to allow for this engagement of the outer tongue 58 in conjunction with an extension of this outer tongue 58 beyond the keeper edge 46 beneath which it is engaged. Again, the tendency of the keeper leaves 48 to close, and for the flange tongues to move toward their initial co-planar relationship with the flange, provides for a positive retention of the tongues. An opening of the fully engaged lock assembly remains relatively simple, requiring only a grasping of the opposed edges of the upper flap 20 and an upwardly pulling of this flap to allow the tongues 56 and 58 to snap out of engagement. Notwithstanding this ease of disengagement, a specific manual effort is required whereby any accidental opening of the lock assembly is substantially completely precluded. Along the same lines, any internal pressure generated, such as by an inverting of the container with the contents flowing against the lid assembly, would merely tend to more firmly close the keeper leaves 48 against the engaged tongues at the locking edges 44 and 46.

As also noted in FIG. 1, the tapered side edges of the locking flaps 18 and 20 provide for a complete exposure of the straw opening defined by the slit-formed triangular tabs 30. Thus, a drinking straw can be introduced into the carton without disturbing the closure.

The foregoing is illustrative of the principles of the invention. While a single embodiment of the carton has been illustrated, it is to be appreciated that other embodiments, particularly with regard to the specific configuration of the carton body, are also contemplated as they fall within the scope of the claims following hereinafter.

I claim:

1. A carton including a hollow body defining an upwardly opening receptacle, said body having a peripheral upper edge forming a receptacle mouth, closure flaps integral with said upper edge and selectively foldable therefrom to overlie and close said receptacle mouth, said closure flaps including a pair of opposed upper and lower locking flaps, each with an outer edge remote from said upper edge of said body, said upper locking flap including a flange portion transversely across said upper locking flap adjacent the outer edge thereof, an inner locking tongue formed from and foldable from said upper locking flap immediately inward of said flange portion and directed away from said outer edge of said upper locking flap, said lower locking flap including a keeper for selectively receiving said tongue upon a locking of said flaps, said keeper comprising an opening through said lower locking flap having spaced first and second lock edges transverse of said lower locking flap and outward of said upper edge of said body, said first lock edge being closer to said outer edge of said lower locking flap than said second lock edge, said tongue, upon a locking of said flaps, being received through said keeper opening beneath said first lock edge and beneath said lower locking flap between said first lock edge and said outer edge of said lower locking flap, said flange portion and inner tongue being foldable about a fold line transversely of said upper locking flap, said flange portion and said inner tongue being positioned to opposite sides of said fold line wherein said flange portion, when upwardly folded, provides a corresponding downward folding of said inner tongue, a pair of keeper leaves selectively movable between a first position overlying said keeper opening and a second position moved away therefrom upon an insertion of said inner tongue, said keeper leaves being defined from said lower locking flap and inherently biased toward said first position, a second outer tongue integral with said flange portion and extending outward from said outer edge of said upper locking flap, said outer tongue, upon a locking of said flaps, being engaged beneath said second lock edge of said keeper opening, said closure flaps further including a pair of opposed inner support flaps selectively foldable over each other beneath said locking flaps and transversely thereof, one of said inner support flaps having a pair of crossed slits defined therethrough adjacent said body upper edge, said slits defining four flexible tabs adapted to be selectively moved to define an opening for the reception of a drinking straw therethrough, said overlying locking flaps, when locked, exposing said slits and the opening defined thereby.

2. A carton including a hollow body defining an upwardly opening receptacle, said body having a peripheral upper edge forming a receptacle mouth, closure flaps integral with said upper edge and selectively foldable therefrom to overlie and close said receptacle mouth, said closure flaps including a pair of opposed upper and lower locking flaps, each with an outer edge remote from said upper edge of said body, said upper locking flap including a flange portion transversely across said upper locking flap adjacent the outer edge thereof, an inner locking tongue formed from and foldable from said upper locking flap immediately inward of said flange portion and directed away from said outer edge of said upper locking flap, said lower locking flap including a keeper for selectively receiving said tongue upon a locking of said flaps, said keeper comprising an opening through said lower locking flap having spaced first and second lock edges transverse of said lower locking flap and outward of said upper edge of said body, said first lock edge being closer to said outer edge of said lower locking flap than said second lock edge, said tongue, upon a locking of said flaps, being received through said keeper opening beneath said first lock edge and beneath said lower locking flap between said first lock edge and said outer edge of said lower locking flap, said closure flaps further including a pair of opposed inner support flaps selectively foldable over each other beneath said locking flaps and transversely thereof, one of said inner support flaps having a pair of crossed slits defined therethrough adjacent said body upper edge, said slits defining four flexible tabs adapted to be selectively moved to define an opening for the reception of a drinking straw therethrough, said overlying locking flaps, when locked, exposing said slits and the opening defined thereby.

3. A carton including a hollow body defining an upwardly opening receptacle, said body having a peripheral upper edge forming a receptacle mouth, closure flaps integral with said upper edge and selectively foldable therefrom to overlie and close said receptacle mouth, said closure flaps including a pair of opposed upper and lower locking flaps, each with an outer edge remote from said upper edge of said body, said upper locking flap including a flange portion transversely across said upper locking flap adjacent the outer edge thereof, a locking tongue on and extending from said flange portion, said lower locking flap including a keeper for selectively receiving said tongue upon a locking of said flaps, said keeper comprising an opening through said lower locking flap having a lock edge transverse of said lower locking flap and outward of said upper edge of said body, said tongue, upon a locking of said flaps, being received through said keeper opening beneath said lock edge and beneath said lower locking flap, said closure flaps further including a pair of opposed inner support flaps selectively foldable over each other beneath said locking flaps, and generally transversely thereof, one of said inner support flaps having angularly related intersecting slits defined therethrough adjacent said body upper edge, said slits forming a flexible tab in said one of said inner support flaps for selective movement of the tab to define an opening for the reception of a drinking straw therethrough, said overlying locking flaps, when locked, exposing said slits and the opening defined thereby.

4. The carton of claim 3 wherein said slits cross each other and form multiple triangular tabs.

* * * * *